United States Patent [19]

Nicodemus

[11] Patent Number: 4,725,201

[45] Date of Patent: Feb. 16, 1988

[54] AUTOMATIC STARTING SYSTEM FOR HYDROKINETIC AMPLIFIER

[75] Inventor: Carl D. Nicodemus, Mumford, N.Y.

[73] Assignee: Helios Research Corp., Mumford, N.Y.

[21] Appl. No.: 9,939

[22] Filed: Feb. 2, 1987

[51] Int. Cl.[4] ..... F04F 5/48

[52] U.S. Cl. ..... 417/54; 417/162; 417/174; 417/189; 417/192; 417/197

[58] Field of Search ..... 417/54, 55, 151, 167, 417/162, 174, 182, 185, 187–189, 192, 193, 197, 198

[56] References Cited

U.S. PATENT DOCUMENTS

| | | | |
|---|---|---|---|
| 978,000 | 12/1910 | Brooke | 417/192 |
| 1,546,712 | 7/1925 | Brooke | 417/162 |
| 2,129,515 | 9/1938 | Williams et al. | 417/162 |
| 2,288,777 | 7/1942 | Bosonetto et al. | 417/192 |
| 2,389,656 | 11/1945 | Williams et al. | 417/193 X |
| 2,513,622 | 7/1950 | Bosonetto et al. | 417/185 X |
| 4,569,635 | 2/1986 | Nicodemus | 417/196 |
| 4,623,301 | 11/1986 | Reynolds | 417/192 X |

FOREIGN PATENT DOCUMENTS

| | | | |
|---|---|---|---|
| 147710 | 11/1936 | Austria | 417/182 |

*Primary Examiner*—Carlton R. Croyle
*Assistant Examiner*—Paul F. Neils
*Attorney, Agent, or Firm*—Stonebraker, Shepard & Stephens

[57] ABSTRACT

Automatic starting of a hydrokinetic amplifier 10 is accomplished by: an overflow pilot valve 32 responsive to output pressure for opening an overflow line 30 when output pressure drops below a predetermined level; and a start-up pilot valve 36 responsive to reduced pressure within amplifier 10 upon opening of overflow pilot valve 32 so that the reduced internal pressure opens the start-up pilot valve and admits vapor into the amplifier to merge with the already flowing liquid and start up the amplifier. Preferably a safety pilot valve 38 arranged in the vapor input line 13, in series with start-up pilot valve 36, closes the vapor input line whenever liquid input pressure to the amplifier falls below an adequate level.

24 Claims, 1 Drawing Figure

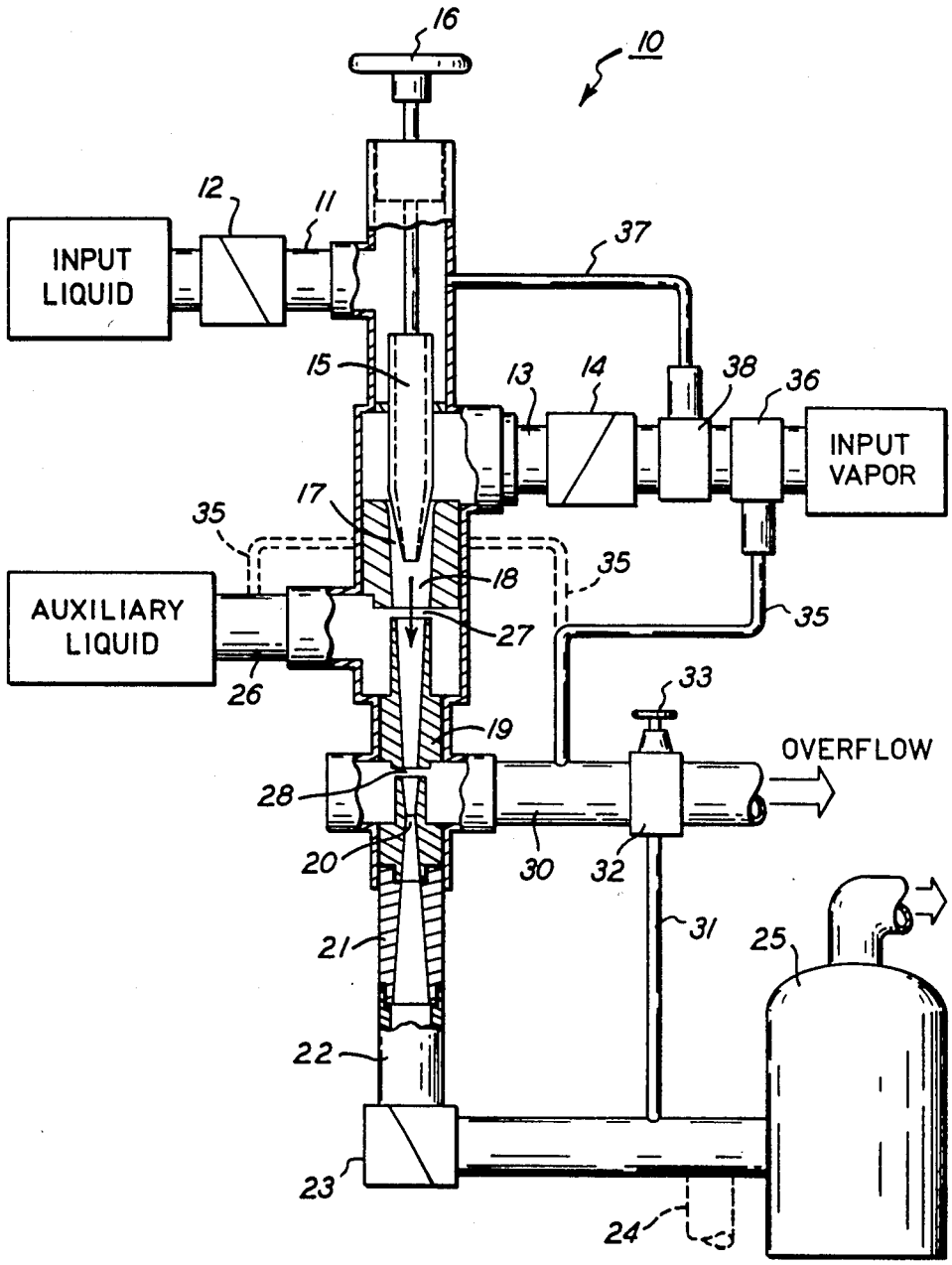
16
10
12
11
INPUT LIQUID
37
15
13
14
38
36
INPUT VAPOR
17
35
35
18
AUXILIARY LIQUID
27
35
26
33
19
OVERFLOW
28
20
30
32
31
21
25
22
23
24

AUTOMATIC STARTING SYSTEM FOR HYDROKINETIC AMPLIFIER

BACKGROUND

Hydrokinetic amplifiers, as explained in my U.S. Pat. No. 4,569,635, amplify liquid pressure by surrounding a liquid jet with a high velocity vapor stream that merges with the liquid and transfers the vapor momentum to the liquid. This accelerates the liquid stream to a higher kinetic energy that converts to a higher pressure in a diffuser. To achieve maximum pressure amplification, hydrokinetic amplifiers require a start-up overflow so that liquid flow can be established through the hydrokinetic amplifier and out the overflow before the accelerating vapor is admitted to merge with the liquid within the hydrokinetic amplifier. When this happens, the amplifier starts and the liquid bypasses the overflow and goes directly to the output discharge at an amplified pressure.

In many industrial environments where hydrokinetic amplifiers work, available steam pressure exceeds available water pressure. Whenever this occurs, it is important to establish liquid flow through the hydrokinetic amplifier before admitting vapor; otherwise, the higher vapor pressure will block the inflow of liquid. If liquid flow is established within the amplifier before vapor input occurs, then the arriving vapor merges with the established liquid stream, condenses, accelerates the liquid, and starts the amplifier running, even though the vapor pressure may be higher than the liquid pressure.

By this invention, I have discovered a way of automatically and reliably starting a hydrokinetic amplifier in response to an output demand. My starting system rapidly and automatically opens valves in the proper sequence to assure start-up of a hydrokinetic amplifier promptly in response to low pressure in its output line, calling for a pressure increase. My system also operates safely and reliably and keeps waste through the overflow to a minimum.

SUMMARY OF THE INVENTION

My automatic starting system applies to a hydrokinetic amplifier having a liquid input line, a vapor input line, an output line for pressurized liquid, and an overflow line for start-up. I use an overflow pilot valve arranged in the overflow line to respond to pressure in the output line so that the overflow pilot valve closes the overflow line whenever pressure in the output line is above a predetermined level, indicating that the amplifier is operating, and opens the overflow line whenever pressure in the output line drops below a predetermined level, calling for a start-up of the amplifier. I arrange a start-up pilot valve in the vapor input line and make the start-up valve responsive to a pressure drop occurring within the hydrokinetic amplifier when liquid flow commences through the amplifier and through the overflow upon opening of the overflow pilot valve. When this pressure drop occurs, the start-up pilot valve opens, admitting vapor to the hydrokinetic amplifier, where it encounters a flowing liquid stream with which the vapor merges to condense the vapor and accelerate the liquid, causing the amplifier to start.

For safety purposes, I prefer a safety pilot valve arranged in the vapor input line in series with the start-up pilot valve and responsive to the pressure of liquid input to the hydrokinetic amplifier. The safety pilot valve is open whenever liquid input pressure is above a predetermined level, ensuring liquid inflow to the hydrokinetic amplifier; and whenever liquid input pressure drops below a predetermined level, the safety pilot valve closes, preventing any vapor input to the amplifier.

DRAWING

The drawing schematically illustrates a hydrokinetic amplifier and my preferred arrangement of pilot valves for my automatic starting system.

DETAILED DESCRIPTION

Hydrokinetic amplifier 10 has a liquid input line 11, preferably with a check valve 12, and a vapor input line 13, preferably with a check valve 14. Liquid from input 11 flows through liquid nozzle 15 that is axially adjustable by means of hand wheel 16. Vapor inflow from line 13 surrounds liquid nozzle 15, passes through annular vapor nozzle 17 and merges with a free liquid jet in chamber 18. The high velocity vapor, as it condenses in the free liquid jet, transfers its momentum to accelerate the liquid through amplifier nozzle 19. The accelerated liquid passes through minimum cross-sectional area 20 and into diffuser 21, where the liquid momentum converts to pressure. Discharge line 22, preferably with check valve 23, provides liquid output at an amplified pressure. This can be used directly via line 24 or can be stored in pressurized reservoir 25.

Auxiliary liquid, such as detergents or processing chemicals, can enter hydrokinetic amplifier 10 via line 26 leading to a gap 27 between chamber 18 and nozzle 19. Another gap 28, upstream of minimum cross-sectional area 20 in nozzle 19, leads to start-up overflow line 30. For start-up purposes, input liquid entering amplifier 10 via line 11 can flow through liquid nozzle 15, and if vapor is not entering amplifier 10, the liquid flow can continue as far as gap 28, where the liquid flows into overflow line 30.

For my automatic starting system, I arrange a pilot valve 32 in overflow line 30, and I make pilot valve 32 responsive to the output pressure in output line 22, transmitted to valve 32 via line 31. I also prefer that pilot valve 32 be adjustable via knob 33 for responding to different pressure thresholds in output line 22. Pilot valve 32 closes overflow line 30 whenever output pressure in line 22 is above a predetermined threshold, indicating adequate operating pressure. When pressure drops below a predetermined level in output line 22, either in response to opening of discharge line 24 or lowering of pressure in reservoir 25 in response to liquid consumption, overflow pilot valve 32 opens. Since liquid under pressure is normally available in input line 11, this opening of the overflow allows liquid to begin flowing through amplifier 10 and overflow line 30.

I arrange start-up pilot valve 36 in vapor input line 13 and make pilot valve 36 responsive to pressure within hydrokinetic amplifier 10 by means of a pressure line 35, preferably connected to overflow line 30. As liquid begins flowing outward in overflow line 30 in response to opening of overflow pilot valve 32, pressure drops within amplifier 10 and within overflow line 30, and this drop in pressure is transmitted via line 35 to start-up pilot valve 36, which then opens. This admits vapor through input line 13 to merge with the liquid stream established within amplifier 10, causing the amplifier to start.

Line 35 can also be connected directly to amplifier 10 to monitor internal pressure within amplifier 10 at gap 27 or 28. One way to do this, as shown by broken lines, is to connect line 35 to auxiliary input line 26 to detect the pressure within amplifier 10 at gap 27.

For safety, I prefer a third pilot valve 38 arranged in vapor input line 13 in series with start-up pilot valve 36, and I make safety pilot valve 38 responsive to liquid input pressure to amplifier 10. For this, I use a pressure-detecting line 37 connected either to liquid input line 11 or to amplifier 10 at the junction of liquid input line 11, as illustrated. Safety pilot valve 38 stays open whenever liquid input pressure is adequate, and closes whenever liquid input pressure falls below a predetermined level.

The conditions necessary to initiate a start-up by my automatic starting system are: adequate liquid input pressure to hold safety pilot valve 38 open in vapor input line 13, and an output pressure in line 22 that drops below a predetermined level, calling for a start-up. The drop in output pressure automatically opens overflow pilot valve 32 which allows liquid flow to commence through amplifier 10 and out through overflow line 30. As soon as this occurs, the pressure drop from the through-flowing liquid automatically opens start-up pilot valve 36 in vapor input line 13. This admits vapor to merge with the already flowing liquid within amplifier 10, where the vapor condenses in and accelerates the liquid through minimum cross-sectional area 20 and into output line 22 via diffuser 21. This automatically starts the amplifier and further reduces the pressure in overflow line 30. Pressure rises quickly in discharge line 22 in response to the start-up, and this closes overflow pilot valve 32 so that overflow line 30 is shut off. The flow through amplifier 10 ensures that the pressure remains low in overflow line 30, however, so that start-up pilot valve 36 remains open and amplifier 10 continues to operate so long as liquid input pressure is adequate. While amplifier 10 is operating, a low pressure exists at gap 27 that can draw in auxiliary liquid via line 26. Amplifier 10 can continue operating under these conditions until output pressure in line 22 reaches a maximum.

The start-up overflow through line 30 to a drain is brief, wasting only a little liquid and practically no vapor. The preferred safety valve 38 ensures that vapor cannot be admitted to amplifier 10 with little or no liquid present, causing a dangerous flow of vapor through overflow 30 or into output line 22. My system also ensures a reliable start-up regardless of the relative input pressures of liquid and vapor, so long as liquid input pressure is adequate.

I claim:

1. An automatic starting system for a hydrokinetic amplifier having a liquid input line, a vapor input line, an output line for pressurized liquid, and an overflow line for start-up, said system comprising:

a. an overflow pilot valve arranged in said overflow line to respond to pressure in said output line for closing said overflow line when pressure in said output line is above a predetermined level and for opening said overflow line when pressure in said output line drops below a predetermined level, calling for a start-up; and b. a start-up pilot valve arranged in said vapor input line for opening said vapor input line in response to a pressure drop occurring within said hydrokinetic amplifier when liquid flow commences through said hydrokinetic amplifier in response to opening of said overflow pilot valve, the successive openings of said overflow pilot valve and said start-up pilot valve causing said hydrokinetic amplifier to start up.

2. The system of claim 1 wherein said pressure drop within said hydrokinetic amplifier is taken from said overflow line upstream of said overflow pilot valve and fed to said start-up pilot valve.

3. The system of claim 1 wherein said pressure drop within said hydrokinetic amplifier is taken from an auxiliary liquid inlet to said hydrokinetic amplifier and fed to said start-up pilot valve.

4. The system of claim 1 wherein said output line leads to a pressurized reservoir, and said output line pressure for said overflow pilot valve is taken between said pressure reservoir and an upstream check valve in said output line.

5. The system of claim 1 including a safety pilot valve arranged in said vapor input line in series with said start-up pilot valve, said safety pilot valve being responsive to liquid input pressure in said liquid input line for opening in response to normal liquid input pressure above a predetermined level and closing in response to liquid input pressure falling below a predetermined level.

6. The system of claim 5 wherein said pressure drop within said hydrokinetic amplifier is taken from said overflow line upstream of said overflow pilot valve and fed to said start-up pilot valve.

7. The system of claim 6 wherein said output line leads to a pressurized reservoir, and said output line pressure for said overflow pilot valve is taken between said pressure reservoir and an upstream check valve in said output line.

8. A pilot valve system for automatically starting a hydrokinetic amplifier having liquid and vapor input lines, a start-up overflow line, and a high pressure discharge line, said system comprising:

a. a start-up pilot valve in said vapor input line and an overflow pilot valve in said overflow line;

b. said overflow pilot valve being arranged to open in response to pressure in said discharge line falling below a predetermined level, calling for a start-up of said hydrokinetic amplifier; and c. said start-up pilot valve being arranged for opening in response to a pressure drop within said hydrokinetic amplifier, occurring in response to liquid flow commencing through said hydrokinetic amplifier and said overflow line when said overflow pilot opens, opening of said start-up pilot valve promptly after opening of said overflow pilot valve causing vapor to flow into said hydrokinetic amplifier and start up said hydrokinetic amplifier by merging with liquid already flowing in said hydrokinetic amplifier.

9. The system of claim 8 including a safety valve arranged in said vapor input line in series with said start-up pilot valve, said safety valve being closed if pressure in said liquid input line falls below a predetermined valve.

10. The system of claim 8 whrein said pressure drop within said hydrokinetic amplifier is transmitted to said start-up pilot valve from a region of said overflow line upstream of said overflow pilot valve.

11. The system of claim 8 wherein said pressure drop within said hydrokinetic amplifier is transmitted to said start-up pilot valve from a region of an auxiliary liquid inlet line to said hydrokinetic amplifier.

12. The system of claim 8 wherein said discharge line includes a check valve and leads to a pressure reservoir, and pressure in said discharge line is transmitted to said overflow pilot valve from a region between said check valve and said pressure reservoir.

13. The system of claim 12 including a safety valve arranged in said vapor input line in series with said start-up pilot valve, said safety valve being closed if pressure in said liquid input line falls below a predetermined valve.

14. A method of automatically starting a hydrokinetic amplifier having liquid and vapor inputs, a start-up overflow, and a high pressure discharge, said method comprising:

a. using pressure below a predetermined level in said discharge for opening an overflow pilot valve in said start-up overflow to initiate a start-up; and b. using a low pressure occurring within said hydrokinetic amplifier in response to liquid flow established upon opening said overflow pilot valve for opening a vapor pilot valve in said vapor input so that valve flows into said hydrokinetic amplifier promptly after establishment of liquid flow through said hydrokinetic amplifier, causing said hydrokinetic amplifier to start.

15. The method of claim 14 including using a safety pilot valve in said vapor input, in series with said vapor pilot valve, for closing said vapor input if liquid pressure in said liquid input falls below a predetermined level.

16. The method of claim 14 including deriving said low pressure occurring within said hydrokinetic amplifier from said overflow upstream of said overflow pilot valve.

17. The method of claim 14 including deriving said low pressure occurring within said hydrokinetic amplifier from an auxiliary liquid inlet to said hydrokinetic amplifier.

18. The method of claim 14 including deriving said discharge pressure from a region of said discharge between an upstream check valve and a downstream pressure reservoir.

19. The method of claim 18 including using a safety pilot valve in said vapor input, in series with said vapor pilot valve, for closing said vapor input if liquid pressure in said liquid input falls below a predetermined level.

20. An automatic starting method for a hydrokinetic amplifier having liquid and vapor input lines, a start-up overflow line, and a high pressure discharge line, said starting method comprising:

a. opening said overflow line whenever pressure in said discharge line falls below a predetermined value, calling for a start-up; and b. opening said vapor input line whenever both:

(1) pressure in said liquid input line is above a predetermined value, ensuring liquid inflow to said hydrokinetic amplifier, and (2) pressure within said hydrokinetic amplifier falls below a predetermined level, indicating establishment of liquid flow through said hydrokinetic amplifier in response to opening of said overflow line;

vapor inflow to said hydrokinetic amplifier upon opening of said vapor input line causing vapor to merge with liquid flowing in said hydrokinetic amplifier.

21. The method of claim 20 including using pilot valves for opening said overflow line and said vapor input line.

22. The method of claim 20 including determining pressure in said discharge line in a region between an upstream check valve and a downstream pressure reservoir in said discharge line.

23. The method of claim 20 including determining said pressure within said hydrokinetic amplifier in an auxiliary liquid inlet region of said hydrokinetic amplifier.

24. The method of claim 20 including determining said hydrokinetic amplifier pressure in a region of said overflow line upstream of a valve in said overflow line.

* * * * *